United States Patent [19]

Giorgi

[11] Patent Number: 5,050,762

[45] Date of Patent: Sep. 24, 1991

[54] TRASH CONTAINER

[76] Inventor: Dusaline Giorgi, 995 Lake Ave., Greenwich, Conn. 06831

[21] Appl. No.: 502,455

[22] Filed: Mar. 30, 1990

[51] Int. Cl.[5] ..... B65D 43/10

[52] U.S. Cl. ..... 220/281; 220/315; 220/343; 220/659; 220/908; 292/80

[58] Field of Search ..... 220/908, 324, 315, 260, 220/281, 659, 306, 342, 343; 292/80, 87, 163, 175, 300; 229/125.29

[56] References Cited

U.S. PATENT DOCUMENTS

| | | | |
|---|---|---|---|
| 1,185,710 | 6/1916 | Perrin . | |
| 1,254,812 | 1/1918 | Klein | 292/300 |
| 1,366,936 | 2/1921 | Rechichar | 220/324 X |
| 1,863,793 | 6/1932 | Hermani | 220/324 X |
| 1,924,222 | 8/1933 | Walter | 229/47 |
| 2,687,157 | 8/1954 | Cowan . | |
| 2,907,491 | 10/1959 | Guhn | 220/908 X |
| 3,063,612 | 11/1962 | Geist . | |
| 3,190,483 | 10/1963 | Robie et al. | 220/908 X |
| 3,275,219 | 9/1966 | McKechnie | 229/125.29 |
| 4,079,880 | 3/1978 | Edwards | 229/45 R |
| 4,295,508 | 10/1981 | Metzger | 150/52 R |
| 4,363,403 | 12/1982 | Raucci, Jr. et al. | 206/387 |
| 4,390,110 | 6/1983 | Pirro . | |
| 4,437,566 | 3/1984 | Szahler . | |
| 4,440,321 | 4/1984 | Campbell et al. . | |
| 4,494,650 | 1/1985 | Cullen . | |
| 4,520,921 | 6/1985 | Vissing . | |
| 4,666,054 | 5/1987 | Jaicks . | |
| 4,863,053 | 9/1989 | Obery . | |
| 4,938,513 | 7/1990 | Gunderson | 292/80 |

*Primary Examiner*—Stephen Marcus
*Assistant Examiner*—Stephen Cronin

[57] ABSTRACT

The present invention provides a trash or garbage container having a main container portion and a closure element permanently mounted to the top of the main container portion. The closure element is selectively movable between an open and closed position, and is removably locked in place on the main container portion in its closed position. One end of the closure element, according to a preferred embodiment of the invention, is hingedly mounted to the main container portion for pivoting the closure element between its opened and closed positions, and an opposed end of the closure element defines an opening which is adapted to engage a complimentary retaining element on the main container portion to removably lock the closure element in its closed position. Either the retaining element, or part or all of the main container, or the portion of the closure element defining the opening, or all of these elements, are formed from a flexible or resilient material so that the closure element may be maneuvered over the retaining element to selectively lock the closure in its closed position. The trash container is designed to require specific manual manipulations to open and close the closure element which cannot be performed by animals such as cats, raccoons, squirrels and skunks, which are known to scavenge trash containers to thereby render the container animal-proof when the closure element is locked on the main container portion.

6 Claims, 2 Drawing Sheets

TRASH CONTAINER

BACKGROUND OF THE INVENTION

1. Field of the Invention

The present invention relates to trash containers having closure elements designed to selectively seal the top of the trash containers and lock a closure element in a closed position atop the trash container. The invention is particularly directed towards animal-proof trash containers of the aforementioned type.

2. Description of the Related Art

The problem of animals such as skunks, raccoons, cats and dogs, scavenging through unattended trash cans is well known. Many attempts have been made to conceive trash containers which address and solve this problem. For example, both the aforestated problems and a proposed solution is discussed in detail in U.S. Pat. No. 4,666,054.

The solution proposed in the U.S. Pat. No. 4,666,054 is to provide a trash container in which a lid is tightly threaded and screwed onto the upper portion of a container, thereby rendering it difficult for an animal to open the container and also preventing odors from escaping from the container. One difficulty with this proposed solution is that a tightly threaded lid connected to a trash container may also be difficult for the owner to open.

Another trash receptacle having a closure element is disclosed in U.S. Pat. No. 4,863,053. The U.S. Pat. No. 4,863,053 incorporates a resilient latch system in which a latch on a cover engages a cooperating latch on a container. The latch system disclosed includes a relatively complicated and presumably expensive cooperating mechanical structure. The actuator for the lid is located externally with respect to the container and remote from the lid structure itself, and is accordingly readily accessible to scavenger animals.

U.S. Pat. No. 4,440,321 discloses a trash can designed to include structure for transferring the contents of the can to expandable trash bags and the like. This patent shows the lower lip of a closure element engaging an upper lip of the container to allow a cover to be removably mounted on the container. Handles on the cover include hook structures which are designed to engage a portion of the container and secure the cover thereon. The cover on such trash cans is easily and completely removable once the hook like structures on the cover are disengaged from the container. Such disengagement frequently occurs when scavengers topple or otherwise manipulate the container.

U.S. Pat. No. 4,390,110 also discloses a trash container in which a top cover may be easily and completely removed from the container body. Slots defined in opposed sides of the container receive portions of the rim of the cover, and a releasable latch structure is provided to removably mount the cover to the container. The cover interlocks with the can using an interlocking hooklike structure similar to the one described in the U.S. Pat. No. 4,440,321. As indicated hereinbefore, the prior art locking mechanisms employing hooklike structures on a cover to engage a portion of a container, are relatively easy for scavengers to defeat.

U.S. Pat. No. 3,063,612 disclosed a container and cover arrangement in which the cover engages the container by an interfitting rib and groove arrangement. This arrangement also includes a pivotal (swingable) catch member on the container which is received through an opening in the cover, thereby requiring various cooperating mechanical elements.

U.S. Pat. No. 1,185,710 discloses a trash receptacle in which a cover is hingedly mounted to a container and secured in a closed position by wires passing through the cover and engaged by external handles mounted to the container. These wires are externally exposed, and therefore readily removable form the external handles on the cover to enable the cover to be opened by a scavenger animal.

Other containers known to the art having closure elements, although not trash containers, are disclosed by U.S. Pat. Nos. 2,687,157; 4,520,920; 4,494,650; and 4,437,566.

The U.S. Pat. No. 2,687,157 is directed to an attache-case type structure in which one pivotal member carries a tab having an opening and a second pivotal member carries a nib 11 adapted to be received in the opening for selectively closing the case.

The U.S. Pat. No. 4,520,920 is directed a child-proof-proof or tamper-proof vial for containing medicines which includes at least two bosses extending outwardly from the side of the container which are adapted to engage two corresponding openings in the cover for selectively locking the cover to the container. The cover is completely removed from the container in the unlocked container.

The U.S. Pat. No. 4,494,650 discloses a display package in which the top part of a container snaps into the bottom part of the container to assemble an overall container structure.

The U.S. Pat. No. 4,437,566 discloses a child-proof container or dispenser having a housing, a tray slideable into an out of the housing, and locking means for the tray including a protuberance which engages a complimentary opening in the housing.

It is apparent that the above described known prior art does not disclose a trash container which can be economically produced with relatively few mechanical components and which, in a preferred embodiment, includes a cover permanently mounted to the container and means for selectively locking the cover in a closed position on the container in a manner which renders the overall container animal-proof. It is the primary object of the present invention to provide a container of this type.

It is a further object of the invention to provide a trash container which can be economically produced with relatively few mechanical components and which, in an alternate embodiment, includes a removable cover which can be placed over the container and cooperate with means for selectively locking the cover in a closed position on the container in a manner which also renders the overall container animal-proof.

SUMMARY OF THE INVENTION

The present invention provides a trash container including a container body having a closed sidewall, a closed bottom surface, and an open top. .A closure element such as a cover or lid is, according to a preferred and illustrative embodiment of the invention, hingedly mounted to the upper portion of the container so that the cover and the container are permanently affixed to one another. The cover may be pivoted between a first position in which the container is opened and a second position in which the container is closed.

A retaining element is provided on the container body at a location opposed to the area in which the cover, of the preferred embodiment, is hingedly mounted to the container. In the context of an illustrative embodiment, the container is annular or cylindrical shaped, and the cover is circular so that the retaining element is located at position diametrically opposed to the hinge on the upper container structure. Containers and cooperating covers having other shapes are contemplated by alternate embodiments of the invention.

The cover includes a downwardly extending peripheral rim or skirt defining an opening or cut out portion which is in radial alignment with the retaining element on the container so that the retaining element is received within the opening to selectively and removably lock the cover on the container body in a closed position. Either the peripheral skirt extending downwardly from the cover, the upper sidewall of the container carrying the retaining element, the retaining element itself, or all of these elements, can be formed from a flexible or resilient material so that the skirt of the cover is easily manipulated or maneuvered over the retaining element to receive the retaining element in the opening.

The retaining element may be a protuberance formed from a flexible material, or it may be a resilient element such as a push button. Unlocking the container requires the same manual manipulations as closing the container except the manipulations are performed in a reverse sequence. Preferably, the retaining element on the container body is formed integrally with the container body, and the downwardly extending skirt on the cover is formed integrally with the cover. The container body and the cover structure may be formed from molded plastic.

In an alternative embodiment, a flexible band may be provided around the opened top of the container body, and the retaining element may be carried on the flexible band and extend outwardly therefrom.

According to still another embodiment of the invention the cover is a separated component, not hinged to the upper portion of the container, with the cover combining a plurality of opening or cut portions for receiving a plurality of retaining elements provided either on said container or said flexible band.

A trash container constructed in accordance with the teachings of the present invention, advantageously provides a locking system which securely retains the cover on the container when desired, but may be easily opened by the owner. However, the locking system is designed such that unlocking the cover from the container requires manual manipulations which cannot readily be performed by scavenger animals.

Accordingly, the trash container provides a locking system which is easily used by humans, but difficult to open by scavenger animals, thereby rendering the trash container animal-proof. Because the trash container contains very few mechanical elements, it may be effectively manufactured at a relatively low cost using known molding techniques.

Other advantages of the invention will become apparent from the drawings and the following detailed description.

PREFERRED EMBODIMENT OF THE INVENTION

Figure 1:
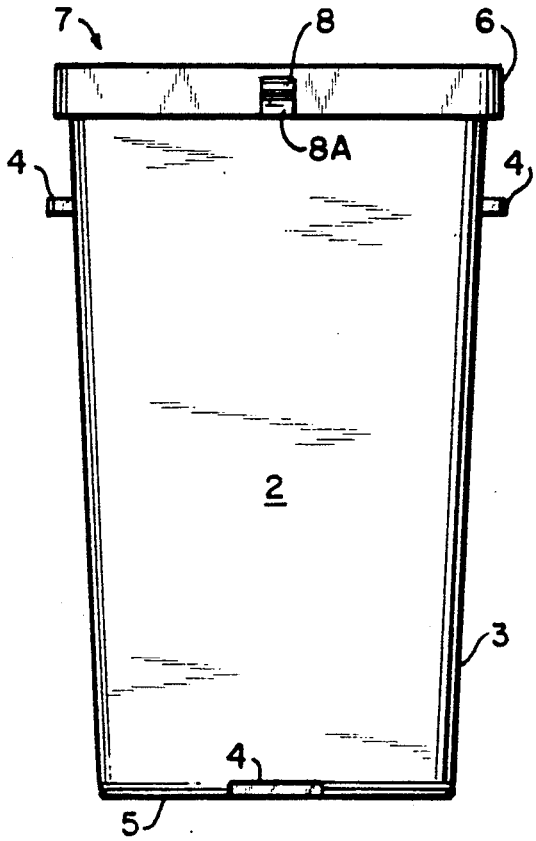
FIG. 1 illustrates a front elevational view of a trash container in accordance with the present invention without a cover mounted thereon.

The trash container in accordance with the present invention will now be described with reference to FIGS. 1 through 5 of the drawing.

FIG. 1 depicts a trash container that includes a main receptacle portion 2 which, as illustrated in the drawing, is generally cylindrical or conical shaped. A pair of handles, 4, may be (and are shown to be) mounted on opposed sides of the outer surface of the receptacle. Another handle, 4, is shown mounted to the bottom of the receptacle, for lifting and moving the trash container.

The receptacle 2 includes a peripheral sidewall 3, a bottom surface of base 5, and an opened top 7. The upper portion of the receptacle 2 defines a peripheral band 6 which carries an outwardly extending button or protuberance 8. In the embodiment disclosed in the drawing, the lower base 5 of the receptacle is approximately seventeen (17) inches in diameter, the height of the receptacle is approximately thirty (30) inches in diameter, the width of the band 6 is approximately two (2) inches, the opened upper surface of the trash container is approximately nineteen (19) inches in diameter, and the button or protuberance 8 is approximately a 1.5 inch square.

The trash container of the present invention includes a cover or closure element 10 adapted, according to one embodiment of the invention, to be hingedly mounted to the top of the receptacle 2 for the purpose of selectively opening and closing the opened top of the receptacle. The cover 10 is formed from a closed top surface 9 and a peripheral skirt 11 which extends downwardly from the outer surface of the top surface of the cover. The cover 10 is configured to conform to the shape of the opened top surface of the container, which, as illustrated in the drawing, is circular having a nineteen (19)

inch diameter corresponding to the diameter of the opened top 7 of the receptacle 2. The width of the closed top surface 9 of the cover 10 is approximately five (5) inches.

Figure 3:
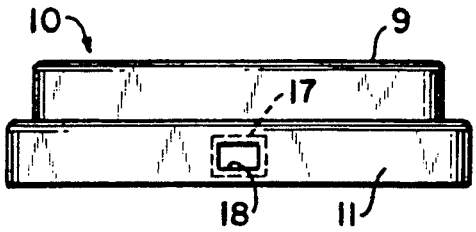
FIG. 3 of the drawing illustrates a front elevational view of a trash container cover suitable for use in accordance with the teachings of the invention.
Figure 4:
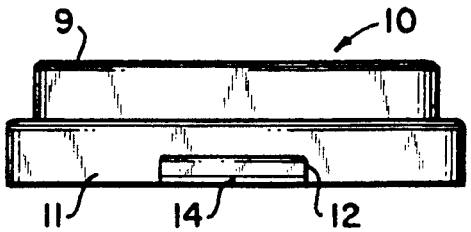
FIG. 4 of the drawing illustrates a rear elevational view of the cover contemplated by the preferred embodiment of the invention, namely a cover for a trash container which may be hingedly attached to the container.
Figure 6:
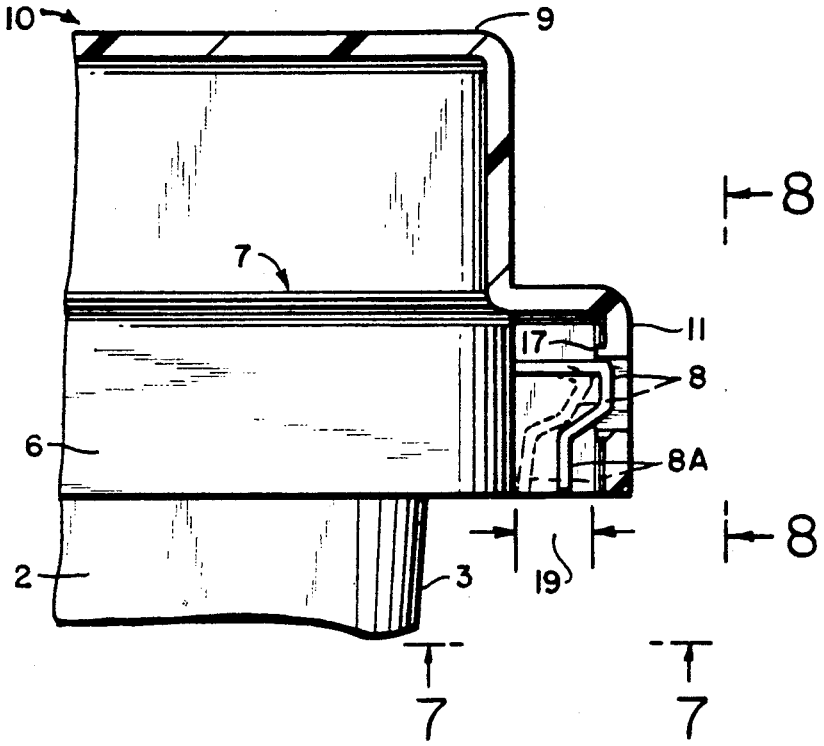
FIG. 6 is an enlarged side elevational view, partly in section taken along the lines 6—6 of FIG. 8, showing a person's finger being inserted on the skirt of the receptacle cover for aligning the protuberance on the receptacle into the opening in the skirt.
Figure 7:
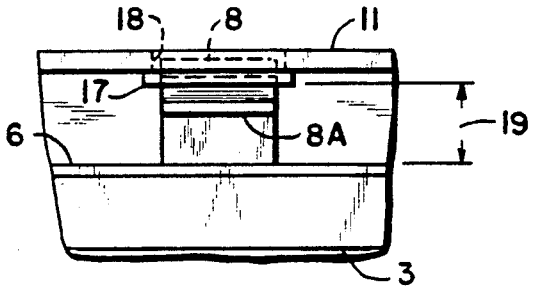
FIG. 7 is a view taken along the lines 7—7 of FIG. 6.
Figure 9:
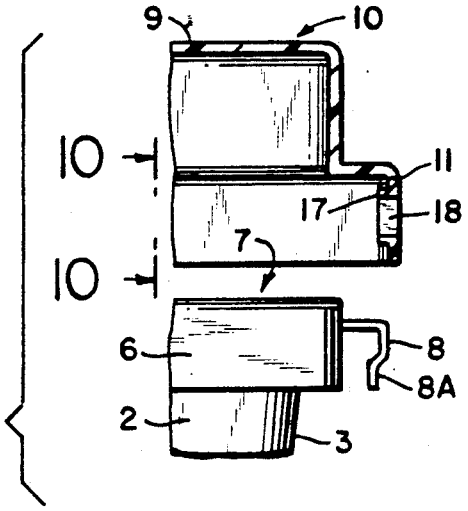
FIG. 9 is an exploded partial side elevational of the trash receptacle and its cover.
Figure 8:
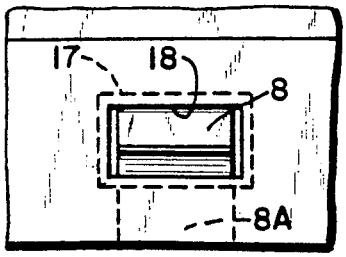
FIG. 8 is an enlarged partial front elevational view of the protuberance on the trash receptacle seated in the opening in the skirt of the receptacle cover.
Figure 10:
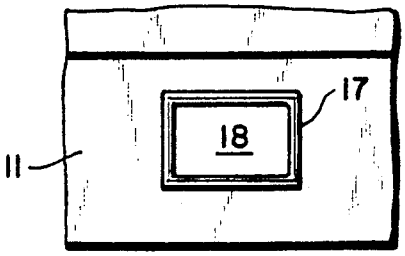
FIG. 10 is a view taken along the lines 10—10 of FIG. 9.

As illustrated in FIGS. 3 and 4 of the drawing, a channel 12 is defined by a portion of the skirt 11 of the cover 10, and corresponding channel 14 is defined on a portion of the band 6 of the receptacle 2. A steel rod 16 is received through the corresponding channels defined in the cover and on the receptacle to hingedly mount the cover 10 to the receptacle 2. In this manner, the cover 10 is pivotal over the opened top 7 of the receptacle 2 between an opened and a closed position.

Figure 2:
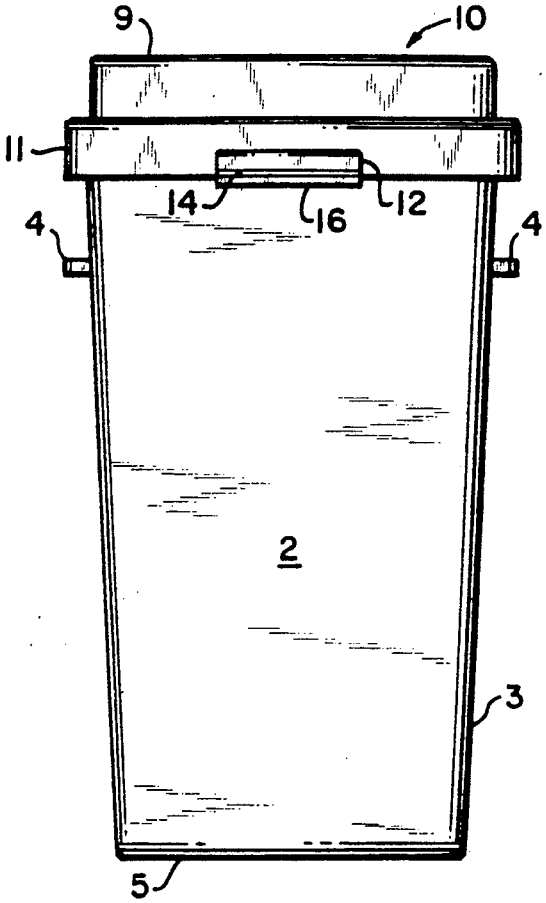
FIG. 2 illustrates a rear elevational view of the trash container illustrated by FIG. 1 with a cover mounted thereon.

Referring now to FIGS. 2-4 of the drawing, a portion of the downwardly extending skirt 11 of the cover 10, which is diametrically opposed to the portion of the skirt defining the channel 12, defines a cut-out or opening 18. The configuration and dimensions of the opening 18 correspond to the configuration and dimensions of the protuberance or button 8 defined on the upper band 6 of the receptacle 2. The button 8 and the opening 18 cooperate with each other and are aligned such that the button 8 is received within the opening 18 when the cover 10 is pivoted into its fully closed position over the top of the receptacle 2. In this manner, the cover 10 is removably locked in its closed position to the receptacle 2 by engagement of the protuberance 8 (which acts as a retaining element) within the opening 18.

Preferably, the band 6 on the receptacle 2 is formed from a flexible or resilient material so that the band may be compressed radially inwardly to allow the skirt of the cover to pass over the protuberance 8 on the band 6 to enable the protuberance to be received within the opening. Once the button and opening are in alignment, the pressure on the band may be released, the band will return to its normal configuration, and the button will be securely engaged in the opening on the cover to removably lock the cover to the receptacle. To unlock the cover from the receptacle, the same manual manipulations are required in a reverse sequence. A lip 17 or other stop means is provided around the inner surface of the opening 18 in the cover to provide a slight clearance or gap 19 between the inner surface of the skirt of the cover and the outer surface of the band 6 to enable the user to readily compress the band 6 to facilitate the unlocking operation. Preferably the band 6 is formed from a resilient, flexible plastic material.

In the embodiment of the invention described above, it is only necessary that the band 6 be formed from a flexible or resilient material to enable the necessary manual manipulations to be performed for locking and unlocking the cover to the receptacle. The cover and the retaining element 8 may be formed from rigid materials.

As an alternative to this embodiment, it is within the scope of the invention that only the retaining element 8 be formed from a resilient material, and that the band 6 and the cover 10 are formed from rigid materials. In this manner, the manual manipulations required to lock the cover on the receptacle by inserting the protuberance B within the opening 18 are exerted only on the flexible protuberance 8. The resilient protuberance is manually compressed inwardly when the cover is received over the receptacle as it is being pivoted into its fully locked position, and the flexible protuberance is likewise compressed inwardly when the cover is pivoted towards its open position. When the protuberance and the opening are aligned, the inward compressive force applied to the protuberance is released and the protuberance expands into its normal configuration and is received within the opening to removably lock the cover to the receptacle. In this alternative embodiment, the band 6 and the cover 10 may be formed from a rigid material.

In a further embodiment of the trash container in accordance with the present invention, the band 6 and the protuberance 8 on the receptacle (and the receptacle itself) may all be formed from a rigid material, while only the cover 10, or the skirt 9 of the cover 10, is formed from a flexible or resilient material. In this embodiment of the invention, the manual manipulations required to lock and unlock the cover on the receptacle include applying an outwardly directed force on the cover 10 in the region thereof proximate to the opening 18 defined on the skirt 9 to maneuver the cover over the top of the receptacle 2 such that the protuberance 8 and the opening 18 are in alignment with each other. When such alignment occurs, the outward force applied to the cover is released, the cover is automatically compressed and returns to its initial configuration, and the protuberance is engaged within the opening on the cover to removably lock the cover to the receptacle.

As a still further embodiment of the present invention, the outwardly directed protuberance or retaining element 8 may be provided by a push button which is spring biased in an outward direction. In order to secure the cover over the receptacle 2, the user will manually manipulate the push button by pressing it inwardly against the spring bias while simultaneously pivoting the cover until the opening in the cover is aligned with the push button. When this occurs, the compressive force applied to the push button is released, the spring bias on the push button urges the push button outwardly, and the push button is engaged within the opening to lock to removably lock the cover on the receptacle.

It is apparent that each of the above described embodiments of the invention requires a series of manual manipulations to both lock the cover to the receptacle and to unlock the cover from the receptacle. These manual manipulations include pivoting the cover either into or out of a fully closed position on the receptacle, while simultaneously applying an inwardly direct compressive force on either the band 6 or the protuberance 8 on the receptacle (or an outwardly directed force on the cover 10), and also observing when the protuberance is in alignment with the opening. Although the simultaneous manual manipulations may be readily performed by a human, they will be difficult to be performed by animals seeking to open a locked trash receptacle. Accordingly, the trash receptacle provided by the present invention is animal-proof.

It is apparent from the above description that it is not necessary for the band 6, the protuberance 8, and the cover 10 to each be formed from a resilient or flexible material. The present invention will function as long as at least one of these elements is formed from a resilient or flexible material. However, it is clearly within the scope of the invention to form more than one of these elements, or all of these elements, from a flexible, resilient material. In the embodiments of the invention in which the band 6 on the receptacle is not formed from a resilient material, the band may be totally eliminated from the receptacle and the outwardly extending protuberance or retaining element 8 may be provided directly on the upper portion of the outer surface of the sidewall 3 of the receptacle 2. In this manner, the receptacle and the protuberance may be integral with one and other and produced in a single molding operation.

In a preferred embodiment of the invention, the receptacle 2 will be formed from a rigid material, and the upper peripheral band 6 will be formed from a flexible or resilient material. In this manner, flexing of the receptacle 2 (as for example, by the receptacle being impacted, knocked down, or rolled over by an animal attempting to gain access) will be eliminated, thereby reducing the possibility of accidental unlocking of the cover by inadvertent disengagement of the retaining element from the opening. As noted above, in other embodiments of the invention, the band 6 may be entirely eliminated and the protuberance may be provided directly on the upper portion of the receptacle 2.

Although the receptacle 2 is disclosed as being generally cylindrically or conically shaped and the cover is of a complimentary circular shape, other configurations of the receptacle and cover are within the scope of the invention. For example, the receptacle may be a square or rectangular configuration, and the cover will be complimentary shaped. The only requirement concerning the configuration of the receptacle and the cover is that the cross sectional configuration of the open top portion 7 of the receptacle compliment the configuration of the cover 10.

Figure 5:
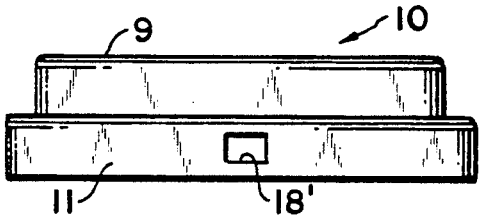
FIG. 5 of the drawing illustrates a rear elevational view of the cover contemplated by an alternate embodiment of the invention, namely a cover for a trash container which may be completely removed from the container and yet, when desired, be secured to the container in the manner contemplated by the invention.

Other modifications within the scope of the present invention will become apparent to those skilled in the art. For example, FIG. 5 depicts an alternate version of a cover contemplated by the invention in which the rear portion of the cover is the same as the front portion of the cover depicted in FIG. 3, i.e., no hinge (making for a completely removable cover), and a second cutout or opening (18') for cooperating with a second protuberance or button on band 6 of receptacle 2. Other contemplated embodiments can employ a multiplicity of openings and cooperating protuberances to secure the cover to the receptacle.

Accordingly, the description of the preferred embodiments of the invention herein are intended to be illustrative only, and not restrictive of the scope of the invention, that scope being defined by the following claims and all equivalents thereto.

What is claimed is:

1. A trash container adapted to prevent access to trash within the container by scavenger animals, said trash container comprising;

(a) A trash receptacle having at least one side wall, a closed bottom and an open top;

(b) A cover hingedly mounted to said trash receptacle proximate to said open top, said cover being pivotable between an open and a closed position;

(c) Said trash receptacle including an outwardly extending protuberance on said at least one side wall;

(d) Said cover including a downwardly extending peripheral skirt having an opening therein, (e) Said cover being mounted to said receptacle such that said protuberance and said opening are aligned with each other for receiving said protuberance in said opening when said cover is in the closed position, and (f) Said trash receptacle having a resilient band around the open top thereof, said protuberance on said trash receptacle being carried by said band and being formed of a resilient material while the remainder of said trash receptacle is formed from a rigid material.

2. A trash container comprising:

(a) A trash receptacle having at least one side wall, a closed bottom and an open top;

(b) a resilient band provided around the open top of said trash receptacle;

(c) a cover hingedly mounted to said resilient band for pivoting said cover between an open and a closed position on said trash receptacle;

(d) said trash receptacle being formed from a rigid material;

(e) said covering including a downwardly extending skirt having an opening therein;

(f) said resilient band having an outwardly extending protuberance provided thereon; and (g) said cover being mounted to said resilient band so that said opening on said downwardly extending skirt of said cover and said protuberance on said resilient band are aligned when said cover is pivoted into said closed position such that said protuberance is received in said opening in order to removably lock said cover in said closed position on said trash receptacle.

3. The trash container as claimed in claim 2 wherein said trash receptacle is in the form of a truncated cone, and said cover is circular.

4. The trash container as claimed in claim 2 wherein said protuberance provided on said resilient band is in a location therein which is opposed to the location of said band on which said cover is hingedly mounted thereto.

5. The trash container as claimed in claim 2 further including a lip defined proximate to said opening on the inner surface of said downwardly extending skirt of said cover for providing a space between said skirt and said flexible band when said cover is in said closed position.

6. A trash container adapted to prevent access to trash within the container by scavenger animals, said trash container comprising;

(a) A trash receptacle having at least one side wall, a closed bottom and an open top and fabricated of a rigid material;

(b) A cover hingedly mounted to said trash receptacle proximate to said open top, said cover being pivotable between an open and a closed position;

(c) Said trash receptacle including an outwardly extending protuberance on said at least one side wall;

(d) Said cover including a downwardly extending peripheral skirt having an opening therein, (e) Said cover being mounted to said receptacle such that said protuberance and said opening are aligned with each other for receiving said protuberance in said opening when said cover is in the closed position, and (f) The skirt of said cover is fabricated of a resilient material whereby the cover is closed over said receptacle by manually manipulating said resilient skirt over the top of said receptacle until said protuberance is received in the opening of said cover.

* * * * *